United States Patent [19]

Kulesza et al.

[11] Patent Number: 4,571,197

[45] Date of Patent: Feb. 18, 1986

[54] IMPACT RESPONSIVE TOY VEHICLE

[75] Inventors: Ralph J. Kulesza, Chicago; Harry Disko, South Barrington, both of Ill.; Stuart A. Cook, New Richmond, Ohio; Jean M. Newton, Park Hills, Ky.; William N. Smith, Batavia, Ohio

[73] Assignee: Marvin Glass & Associates, Chicago, Ill.

[21] Appl. No.: 695,879

[22] Filed: Jan. 29, 1985

[51] Int. Cl.[4] ..... A63H 17/02

[52] U.S. Cl. ..... 446/6; 446/471

[58] Field of Search ..... 446/6, 4, 470, 471, 446/465, 435

[56] References Cited

U.S. PATENT DOCUMENTS

| | | | |
|---|---|---|---|
| 1,145,420 | 7/1915 | Huth | 446/4 |
| 1,288,813 | 12/1918 | Blackshear | 446/6 |
| 2,116,279 | 5/1938 | O'Donnell | 446/6 |
| 2,558,257 | 6/1951 | Koepnick | 446/4 X |
| 4,413,443 | 11/1983 | Kulesza et al. | 446/471 X |

*Primary Examiner*—Mickey Yu

*Attorney, Agent, or Firm*—John S. Pacocha

[57] ABSTRACT

An impact responsive toy vehicle in which two separable halves each carrying surface engaging wheels are connected together to provide a vehicle supported on the surface engaging wheels. A torsion spring biases the joinable ends of the two halves to separate and each flip over. The parts are retained together by a connecting latch that is disengageable by a slidable lever that moves in reponse to a force on an extending front bumper. One half carries a rotatable lock including a lug that cooperates with an abutment on the lever to lock the trigger lever against sliding movement in response to impact on the bumper. Fail-safe combination of the two parts rendering the impact responsive feature totally inoperative is accomplished by assembling the parts together with the arm of the torsion spring received in a recess on the underside of the chassis of the other half.

19 Claims, 11 Drawing Figures

IMPACT RESPONSIVE TOY VEHICLE

BACKGROUND OF THE INVENTION

1. Field of the Invention

This invention relates generally to toy vehicles and more particularly to toy vehicles having a biased action feature responsive to impact.

2. Background Art

There are toy vehicles in the prior art in which a part or all of the body breaks or explodes away from a unitary chassis that carries the surface engaging wheels on spaced apart parallel axles as a result of a crash or impact. Examples of such prior art toy vehicles are shown in U.S. Pat. Nos. 2,757,482; 3,176,429; 3,734,500; 3,959,920; and 4,413,443. Other prior art toy vehicles such as those shown in U.S. Pat. Nos. 2,597,094 and 1,363,891 have chassis parts that are pivotally connected together along an axis parallel to the surface engaging wheel axles and open up in response to impact. Still other prior art toy vehicles like those shown in U.S. Pat. Nos. 3,000,137; 3,445,959; and 4,466,214 plus published British Patent Application GB2,033,766A have spring loaded lever arms that are released in response to impact to engage the surface supporting the vehicle in order to flip or overturn the vehicle. Particularly as such crash responsive toy wheeled vehicles have long been popular toys, there is a continuing demand for more entertaining and exciting devices of this type. It would be particularly desirable to have an impact responsive toy wheeled vehicle that would both break apart and flip over without requiring a separate spring loaded lever arm to flip the vehicle. In addition to providing such an impact responsive toy vehicle with a lock-out to prevent the impact responsive action during normal play it would also be desirable to provide a virtually fail-safe way of putting the parts of the vehicle together with the impact responsive feature rendered totally inoperative.

SUMMARY OF THE INVENTION

The present invention in concerned with providing a toy wheeled vehicle having parts that separate and flip over when the vehicle impacts an obstruction and also having a lock-out to selectively prevent such a response on impact as well as a fail-safe way of putting the parts together to render the impact responsive feature inoperative. These and other objects and advantages of the invention are achieved by providing a toy vehicle with connectable separate first and second parts each having surface engaging wheels and joinable together at one end with a spring carried by one of the parts to bias away the joinable end of the other part when the parts are connected together in a combination supported on the surface engaging wheels. A resilient latch on one part cooperates with a bar on the other part to retain the parts connected against the bias. In response to impact on an exposed end, a moveable lever pushes against the resilient latch with the inner end of the lever to disengage the latch from the bar. Carried for rotation by the vehicle is a lug, which in one rotational position engages an abutment sill on the lever to lock the lever against movement upon impact. The separate parts can be connected together in another combination with the biasing spring so positioned as to not bias the parts to separate and so render the impact responsive inoperative.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
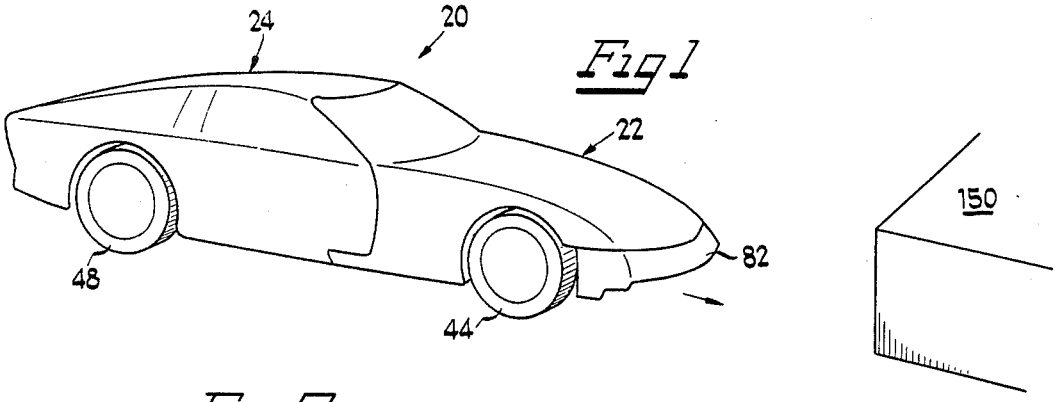
FIG. 1 is a perspective view of a vehicle embodying the present invention prior to impact.

Referring now to the drawings in which like parts are designated by like reference numerals throughout the several views, there is shown in FIG. 1 a toy vehicle 20 in a sports car style. The vehicle is separable into a front half 22 and a rear half 24 transverse to the longitudinal center line of the vehicle. Front half 22 has a lower chassis 26 and an upper body 28 that are attached together by respective posts 30 (only one of which is shown) fitting into wells 32 (only one of which is shown). Rear half 24 is similarly composed of a rear chassis 34 with an upper rear body 36 attached together by posts 38 (only one of which is shown) projecting upwardly from the chassis and received in wells 40 (only one of which is shown) depending downwardly from the underside of the rear body. Only one post and well combination for each of the front and rear halves of the vehicle is illustrated to facilitate showing the other parts of the vehicle.

Mounted for rotation relative to a playing surface is a front axle 42 with end mounted front wheels 44 on the front half 22 and rear axle 46 with end mounted rear wheels 48 on the rear half 24. A motor 50 of any conventional battery, spring, or inertia powered type may be housed in the rear half and drivingly connected to the rear axle 46. Each of the front half and the rear half parts have a joinable end 52 and 54, respectively. In addition, each of the parts has a respective free end 56 and 58. When the front half 22 and rear half 24 are connected together at the joinable ends, the combination is a vehicle supportable on the surface engaging front and rear wheels 44 and 48.

Figure 4:
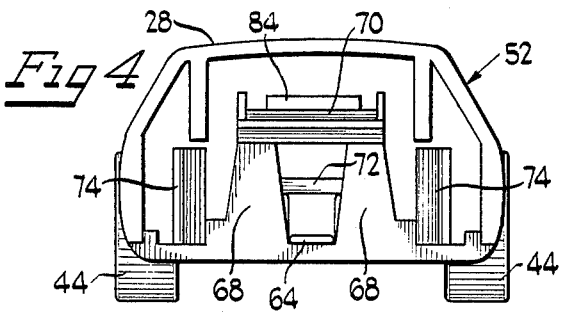
FIG. 4 is an elevational view of the joinable end of the front half of the vehicle.
Figure 5:
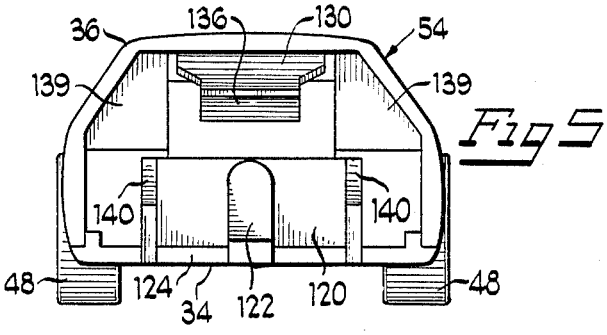
FIG. 5 is an elevational view of the joinable end of the rear half of the vehicle.
Figure 8:
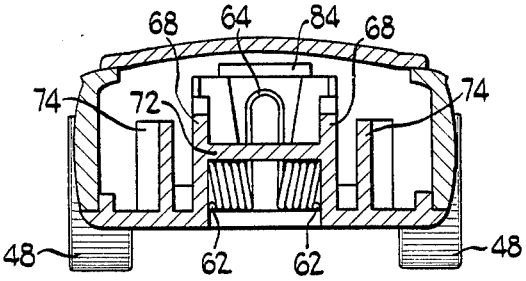
FIG. 8 is a sectional view taken generally along the line 8—8 of FIG. 6.
Figure 9:
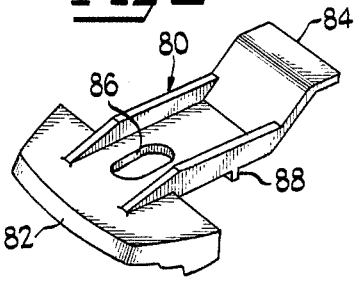
FIG. 9 is a further enlarged scale perspective view of the trigger.
Figure 10:
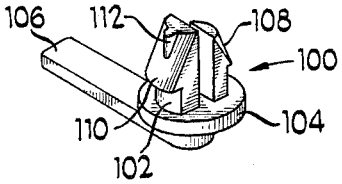
FIG. 10 is a perspective view of the rotatable lock.

Carried in the front half 22 is a torsion spring 60 which lies along the joinable end of the front chassis 26 and has end arms 62 bearing against the inside upper surface of the chassis. A center arm 64 of the torsion spring is formed as an extending loop and lies generally along the longitudinal center line of the vehicle. Center arm 64 is pivotally moveable from the loaded, upraised, position best illustrated in FIGS. 6 and 8 to an unloaded, at rest, position, as illustrated in FIG. 4, in which the center arm lies generally in a horizontal plane.

Extending upwardly from the front chassis 26 adjacent the joinable end 52 are a pair of spaced apart upright standards 68. The center arm 64 of the torsion spring extends through the space between the standards. Bridging across the top of the standards 68 is a generally horizontally disposed bar 70. A shelf 72 is connected across the standards 68 spaced above the chassis 26 and extending toward the free end 56. The space between the upper side of the chassis and the lower side of the shelf 72 accommodates and retains the torsion spring 60. Spaced outboard of the standards 68, and for the most part lying generally parallel to the longitudinal center line are a pair of deflector fins 74 that are formed as an integral part of the front chassis 26 and extend upwardly from the chassis. Adjacent the joinable end the deflector fins flare outwardly towards the sides of the vehicle. Front chassis 26 includes a pair of slots or notches 76 spaced apart on either side of the longitudinal center line of the vehicle and extending upwardly from the underside of the chassis at the forward end of the notches is a ledge 78.

A trigger lever 80 is carried by the front half for sliding movement between the free end and the joinable end. Lever 80 includes an exposed end in the form of a front bumper 82 and an inner actuator end 84. Intermediate the ends an oblong opening 86 accommodates the post 30 and well 32 during sliding movement of the trigger lever 80. Depending downwardly from the lever is an abutment sill 88. Chassis 26 includes an integrally formed upwardly extending strut 92 and body 28 includes a downwardly extending retainer extension 94, both of which provide support for the trigger lever 80.

Figure 6:
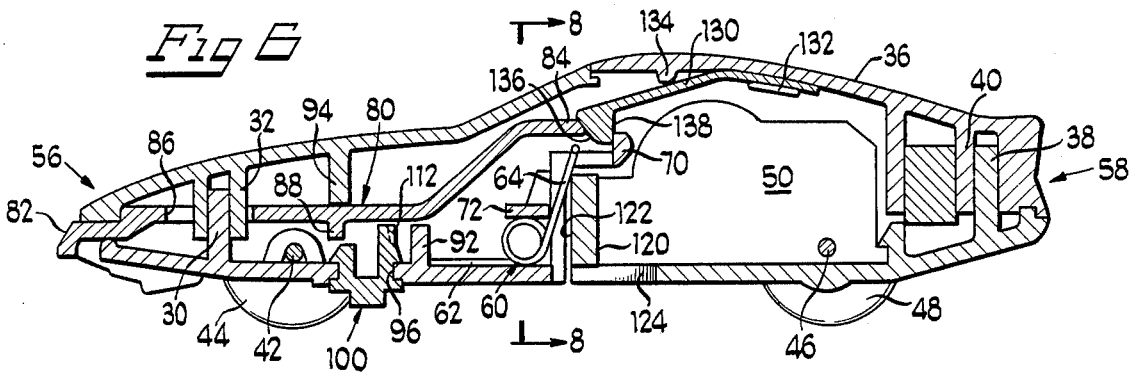
FIG. 6 is a sectional view taken generally along the line 6—6 of FIG. 3.
Figure 7:
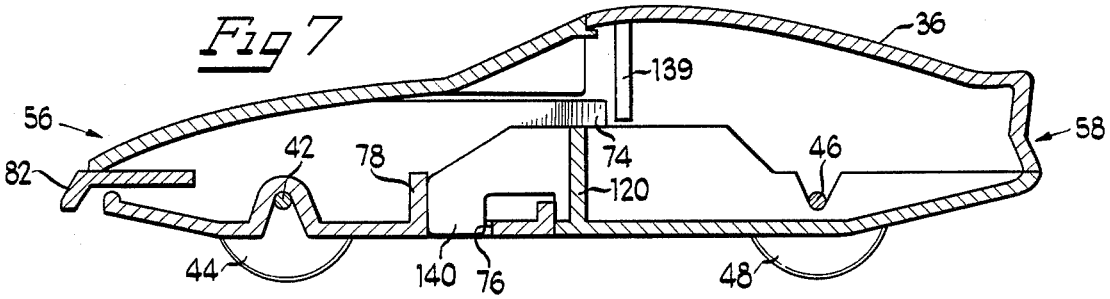
FIG. 7 is a sectional view taken generally along the ling 7—7 of FIG. 3.
Figure 11:
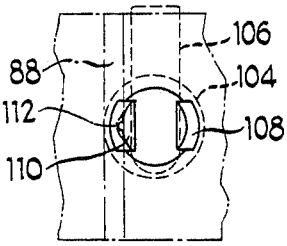
FIG. 11 is a fragmentary view showing the rotatable lock in the trigger locking position.

Front chassis 26 includes a circular opening 96 which receives a rotatable lock 100. The lock includes a middle body portion 102 which is received for rotational movement within the circular opening 96. A lower annular flange 104 limits the extent to which the lock 100 may be inserted into the opening from the underside of the chassis. Extending radially from the flange 104 is a handle 106. Projecting upwardly from the cylindrical body 102 are a pair of spaced apart angled lips 108 and 110. The lips may be sufficiently compressed together for insertion of the lock into the central opening and then by their inherent resiliency expand to, as best shown in FIGS. 6 and 11, rotatably retain the lock 100 within the circular opening 96 against removal. Lip 110 includes an outwardly projecting lug 112.

Rear half 24 has, adjacent the joinable end 54, an integrally formed wall 120 extending upwardly from the rear chassis 34. Wall 120 provides a bearing surface 122 against which the center arm 64 of the torsion spring 60 is urged when the front and rear half parts are connected together with the spring in its loaded position. Generally along the longitudinal center line of the vehicle a recess 124 is provided on the chassis 34 adjacent the joinable end to accommodate the center arm 64 of the torsion spring in the generally horizontal rest or unloaded position.

A latch 130 is attached at its back end to the underside of the rear body 36 by an upset plastic rivet 132 or other suitable fastening means. Bead 134 on the underside of the rear body 36 intermediate the attachment of the back end of the latch and the joinable end 54 of the rear half spaces the latch 130 from the underside of the body. Latch 130 is made of a material that is sufficiently resilient to permit the normally downwardly biased latch to be deflected upwardly. The front edge 136 of the latch is angled to provide a camming surface while the rear edge 138 is generally vertical. Rear edge 138 of the latch 130 engages the bar 70 carried by the front half when the two parts are connected together and the front edge 136 is in proximity to the inner actuator end 84 of the trigger lever 80. Depending downwardly from the underside of the rear body 36 on either side of the latch 130 are spaced apart side braces 139.

Extending outwardly from the joinable end 54 of the rear half and spaced apart generally parallel to the longitudinal center line of the vehicle are a pair of hooks 140 connected together by wall 120. The hooks, which are rigid relative to the latch 130, along with the wall may be integrally formed as part of the chassis 34. When the front and rear parts are connected together, the hooks 140 mate with, or are received in, the notches 76 of the front chassis 26. Deflector fins 74 facilitate connecting the parts together by guiding the insertion of the hooks 140 into position to be received in the notches.

In operation, the two separable halves may be connected together by placing the lower edges of the two joinable ends adjacent each other and then pivoting the two parts together to close the upper opening. This pivotal closing together of the parts brings the center arm 64 of the spring up against the bearing surface 122 loading the spring as the parts are brought together and at the same time inserts the hooks 140 in the spaces between the deflector fins 74 and the upright standards 68 to bring the hooks into position to be received in the notches 76. As the two parts finally come together, the front edge 136 of the latch is cammed over the bar 70 until the downward bias of the latch drops the rear edge over the bar securing the two parts together.

Figure 2:
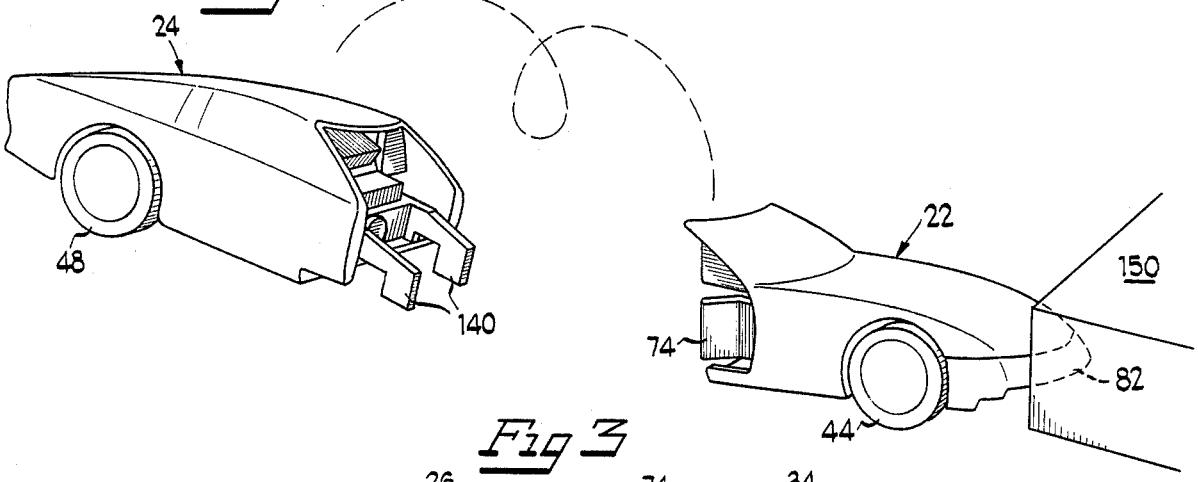
FIG. 2 is a perspective view of the vehicle after impact.
Figure 3:
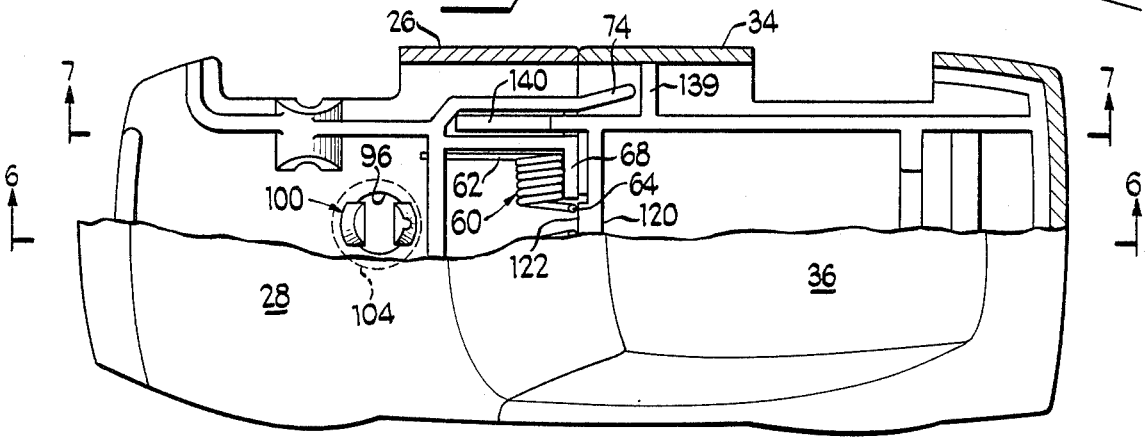
FIG. 3 is an enlarged scale, top plan view of the vehicle partially in section.

With the rotatable lock 100 in the position illustrated in FIG. 6, the trigger lever 80 is free to move rearwardly which would bring the actuator end 84 against the front camming edge 136 to push the latch 130 up and back over the bar 70. When the latch 130 is released from the bar 70, the downward and outward bias exerted by the center arm 64 of the spring against the bearing surface 122 of the rear half forces the two halves apart and at the same time causes them to each flip over as illustrated in FIG. 2. The necessary rearward movement of the trigger lever 80 results from propelling the vehicle 20 forwardly against an obstruction 150 so that the front bumper 82 impacts against the obstruction.

If desired, the parts may be connected together with the spring loaded and the impact responsive feature momentarily locked out by rotating the lock 100 to bring the lug 112 into a position 180 degrees opposed from that shown in FIG. 6 to the position shown in FIG. 11 where the lug 112 is abutting the downwardly depending sill 88. Trigger lever 80 would then be locked or prevented from moving inwardly even should the front bumper 82 impact an obstruction.

For fail-safe connection of the two halves together so that the impact responsive feature is totally inoperative, the two halves are connected together in a manner similar to that already described except that at the outset the outwardly extending, generally horizontally disposed center arm 64 of the spring is positioned in the recess 124 in the rear chassis 34 so that the spring is not loaded as the parts are pivoted together. This second type of alternative combination of the two parts may be particularly desirable for storage or shipment of the toy vehicle.

While a particular embodiment of the invention has been shown and described, it will be apparent to those skilled in the art that changes and modifications may be made without departing from the invention. It is intended in the appended claims to cover all such changes and modifications as fall within the true spirit and scope of the invention.

What is claimed as new and desired to be secured by Letters Patent is:

1. An impact responsive toy vehicle comprising:
connectable separate first and second parts;
each of the first and second parts having at least one surface engaging wheel;
each of the first and second parts having a free end and a joinable end;
means carried by one of the first or second parts adjacent the joinable end for biasing the joinable end of the other of the first and second parts to separate;
means carried adjacent the joinable end of each of the first and second parts for connecting the first and second parts together into a combination supportable on the surface engaging wheels;
the connecting means including a resilient latch carried by one of the first or second parts;
a bar carried by the other of the first or second parts with the latch engaging the bar to connect the first and second parts together;
a moveable lever having an exposed end and an inner end carried by one of the first or second parts and being moveable by an impact force on the exposed end of the lever to push the inner end against the resilient latch to disengage the latch from the bar.

2. The impact responsive toy vehicle of claim 1 including means for locking the lever against movement to prevent the inner end of the lever being pushed against the resilient latch.

3. The impact responsive toy vehicle of claim 2 in which:
the locking means includes a rotatable lug carried by the first or second part carrying the moveable lever;
the lever includes an abutment; and
the lug, in one rotational position, engages the abutment to lock the lever against movement.

4. The impact responsive toy vehicle of claim 1 in which:
the biasing means is a torsion spring having an arm that is pivotally moveable from a rest position to a loaded position;
the first or second part not carrying the torsion spring having a bearing surface against which the arm of the torsion spring is urged; and
the arm being pivoted from the rest position into the loaded position when the first and second parts are connected together.

5. The impact responsive toy vehicle of claim 4 in which:
the first or second part not carrying the torsion spring has a bottom; and
a recess in the bottom receives the arm in the rest position permitting the first and second parts to be connected together in an unbiased combination.

6. The impact responsive toy vehicle of claim 1 in which the resilient latch is biased down into engagement with the bar.

7. The impact responsive toy vehicle of claim 1 including:
a bottom on each of the first and second parts;
the first or second part carrying the resilient latch also carrying a relatively rigid hook; and
a notch in the bottom of the first or second part not carrying the hook receiving the hook when the first and second parts are connected.

8. The impact responsive toy vehicle of claim 7 in which:
the vehicle has a longitudinal center line;
a relatively rigid hook mates with a receiving notch on either side of the longitudinal center line; and
the biasing means and resilient latch are substantially along the longitudinal center line between the hooks.

9. The impact responsive toy vehicle of claim 8 in which:
the part having the hook receiving notches in the bottom also has a pair of spaced fins; and
each of the fins diverge outwardly from the center line toward the joinable end of the first or second part to guide the insertion of the hooks.

10. An impact responsive toy vehicle comprising:
separable connectable first and second parts;
biasing means carried by one of the parts for urging the connected parts to separate;
connecting means for selectively connecting the first and second parts together in either a first combination in which the biasing means is positioned to urge the parts to separate and a second combination in which the biasing means is positioned to be ineffective;
the biasing means being a torsion spring having an arm that is pivotally moveable from a rest position to a loaded position;
the first or second part not carrying the torsion spring having a bearing surface against which the arm of the torsion spring is urged;
the arm being pivoted from the rest position into the loaded position when the first and second parts are connected together in the first combination;
the first or second part not carrying the torsion spring having a bottom; and
a recess in the bottom receiving the arm in the rest position permitting the first and second parts to be connected together in the second combination.

11. An impact responsive toy vehicle comprising:
separable connectable first and second parts;
biasing means carried by one of the parts for urging the connected parts to separate;
connecting means for selectively connecting the first and second parts together in either a first combination in which the biasing means is positioned to urge the parts to separate and a second combination in which the biasing means is positioned to be ineffective;
a resilient latch carried by one of the first or second parts and a bar carried by the other of the first and second parts;
the latch engaging the bar to releasably connect the first and second parts together; and
a moveable lever having an exposed end and an inner end carried by one of the first or second parts and being moveable by an impact force on the exposed end of the lever to push the inner end against the resilient latch to disengage the latch from the bar.

12. The impact responsive toy vehicle of claim 11 in which the resilient latch is biased down into engagement with the bar.

13. The impact responsive toy vehicle of claim 11 including means for locking the lever against movement to prevent the inner end of the lever being pushed against the resilient latch.

14. The impact responsive toy vehicle of claim 13 in which:

the locking means includes a rotatable lug carried by the first or second part carrying the moveable lever;

the lever includes an abutment; and the lug, in one rotational position, engages the abutment to lock the lever against movement.

15. The impact responsive toy vehicle of claim 11 in which:

the vehicle has a longitudinal center line;

a relatively rigid hook on one part mates with a receiving notch on the other part on either side of the longitudinal center line; and the biasing means and resilient latch are substantially along the longitudinal center line between the hooks.

16. The impact responsive toy vehicle of claim 15 which:

the part having the hook receiving notches also has a pair of spaced fins; and each of the fins diverge outwardly from the center line toward the joinable end of the first or second part to guide the insertion of the hooks.

17. The impact responsive toy vehicle of claim 11 including:

a bottom on each of the first and second parts;

the first or second part carrying the resilient latch also carrying a relatively rigid hook; and a notch in the bottom of the first or second part not carrying the hook receiving the hook when the first and second parts are connected.

18. The impact responsive toy vehicle of claim 17 in which:

the vehicle has a longitudinal center line;

a relatively rigid hook mates with a receiving notch on either side of the longitudinal center line; and the biasing means and resilient latch are substantially along the longitudinal center line between the hooks.

19. The impact responsive toy vehicle of claim 18 which:

the part having the hook receiving notches in the bottom also has a pair of spaced fins; and each of the fins diverge outwardly from the center line toward the joinable end of the first or second part to guide the insertion of the hooks.

* * * * *